United States Patent [19]

De Leon

[11] 4,141,611

[45] Feb. 27, 1979

[54] COVER FOR DISPLAY TYPE REFRIGERATING CABINET

[76] Inventor: John N. De Leon, 837 N. Feather Ave., La Puente, Calif. 91746

[21] Appl. No.: 861,172

[22] Filed: Dec. 16, 1977

[51] Int. Cl.[2] ..... A47F 3/04

[52] U.S. Cl. ..... 312/116; 62/246; 160/330

[58] Field of Search ..... 312/116; 62/246, 249, 62/261; 160/238, 330, 243; 61/1 F

[56] References Cited

U.S. PATENT DOCUMENTS

| | | | |
|---|---|---|---|
| 2,069,600 | 2/1937 | Coleman | 160/330 |
| 3,170,714 | 2/1965 | Stalker | 160/DIG. 16 |
| 3,241,899 | 3/1966 | Donker | 312/116 |
| 3,437,127 | 4/1969 | Lukashok | 160/330 |
| 3,465,536 | 9/1969 | Vogel et al. | 62/255 |
| 3,999,821 | 12/1976 | Moody et al. | 312/116 |

*Primary Examiner*—Mervin Stein
*Assistant Examiner*—Alex Grosz
*Attorney, Agent, or Firm*—Fred N. Schwend

[57] ABSTRACT

A removable insulating cover for a display type refrigerating cabinet is formed of spaced sheets of flexible plastic secured along their edges and along spaced seam lines extending parallel to the length of the cover to form narrow contiguous panels. Relatively thick layers of loosely packed glass fibers fill the panels. The cover is adapted to be suspended across the opening of the cabinet to prevent a transfer of heat through the opening and into the interior of the cabinet during certain periods of time.

2 Claims, 5 Drawing Figures

COVER FOR DISPLAY TYPE REFRIGERATING CABINET

BACKGROUND OF THE INVENTION

1. Field of the Invention

This invention relates to upright or display type refrigerating cabinets, such as are used in food markets for displaying frozen foods and the like, and has particular reference to a removable insulating cover for covering the access opening of such cabinet.

2. Description of the Prior Art

Refrigerating display cabinets of the above type, having vertical access openings therein, have been in use for many years in food stores and are highly desirable because they display frozen or refrigerated goods at substantially eye level and permit the store customer to easily reach through the vertical access opening to obtain any selected items. However, due to the vertical disposition of the access opening, cold air from the interior of the cabinet tends to spill out into the surrounding atmosphere. This not only forms a source of discomfort to customers standing in front of the cabinet, because of the resulting cold air drafts, but requires a considerable and wasteful expenditure of electrical energy in order to cause the refrigeration apparatus for the cabinet to maintain the interior of the cabinet and its contents at a desired low temperature level.

Although most cabinets of the above type provide means for producing a downward flowing curtain of refrigerated air across the access opening to retard the spilling of cold air outwardly through the opening, this measure is only partly effective and is acceptable only because of the convenience of the vertical access opening to the customers. However, on off-business hours, such as at night or on weekends and holidays, the temperature in the cabinet must still be maintained at substantially the same low temperature to prevent food spoilage, thus requiring the same large expenditures of energy, unless means can be provided to conveniently close the access opening during such times.

Heretofore, various types of covers have been proposed for closing the access openings of refrigerating cabinets of the above type during off hours. Such covers are generally of two types. For example, the U.S. Patents to G. K. Bently et al, No. 3,186,185; W. R. Donker No. 3,241,899; and W. R. Donker No. 3,542,445 disclose thin sheets of plastic which are stretched or otherwise extended over the access opening and are rolled up when not in use. Although such covers can be readily rolled into a relatively small space when not in use, they are obviously relatively poor heat insulators because of their thin sheet-like form and cannot adequately prevent the transfer of heat into the cabinet over sustained time periods. The patent to R. E. Vogel et al, 3,465,536, on the other hand, is directed to a rigid type cover constructed of relatively thick inter fitting panels of urethane foam plastic or the like. This type of cover is generally satisfactory in its insulating characteristics because of the good insulating quality of the thick plastic foam. However, such panels present a nuisance in that they are relatively large and cumbersome to handle and must be physically removed from the access opening during business hours and then replaced afterward. Further, the panels require a large storage space and must be carefully handled since the plastic foam is relatively fragile.

SUMMARY OF THE INVENTION

The principal object of the present invention is to provide an effective removable insulating cover for the access opening of a display type refrigerating cabinet which is relatively light and easy to handle.

Another object of the invention is to provide a cover of the above type which may be quickly and easily mounted on and removed from a display type refrigerating cabinet.

Another object of the invention is to provide a cover of the above type which may be readily folded and stored in a relatively small space.

A further object is to provide a cover of the above type which is simple and inexpensive to manufacture.

According to the present invention, a relatively thick, but light weight flexible thermal insulating cover is provided, comprising two overlaid sheets of thin flexible plastic, such as vinyl, which are secured and sealed together along their outer edges and along spaced horizontally extending seams to form narrow horizontally extending contiguous panels which are filled with loosely packed heat insulating fibers. Such fibers, preferably glass, are loose and unoriented and, therefore, provide excellent heat insulating properties while permitting flexing of the panels. Since the layers are separated vertically by the various narrowly spaced horizontal seams, there is little or no tendency for the fibers to settle or pack along one edge of the cover due to handling, folding, or the like. This construction permits the cover to be easily folded along any of the seam lines into a relatively flat package for storing. Also, because of this construction, a cover of relatively large area can be easily, quickly and conveniently handled by a single person.

The cover and its supporting means effect an intimate sealing engagement with the edges of the access opening of the cabinet to prevent leakage of air through the opening when the cover is installed.

BRIEF DESCRIPTION OF THE DRAWINGS

The manner in which the above and other objects of the invention are accomplished will be readily understood from the following specification when read in conjunction with the accompanying drawings, wherein.

DESCRIPTION OF THE PREFERRED EMBODIMENT

Figure 1:
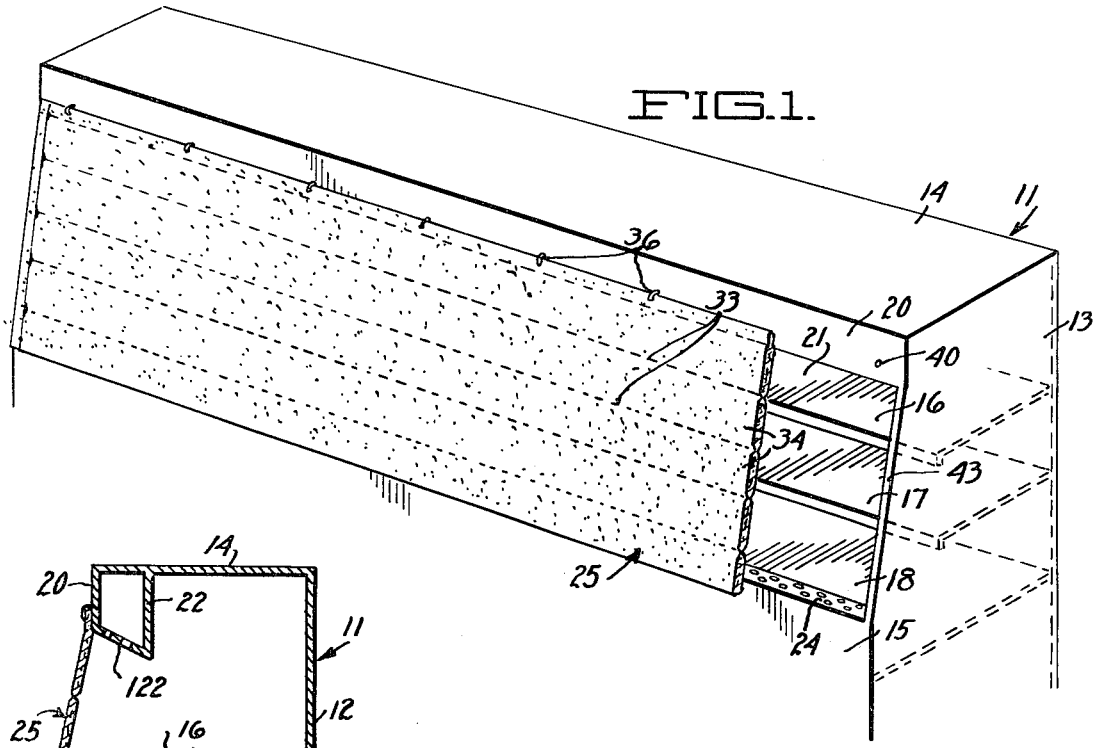
FIG. 1 is a front perspective view of a typical display type refrigerating cabinet having a vertical access opening and showing a cover, partly broken away, embodying a preferred form of the present invention.

A typical display type refrigerating cabinet is generally indicated at 11 and comprises a rear wall 12, end walls, one of which is shown at 13, a top wall 14, and a front wall 15. The rear, end and front walls extend upwardly from the floor. Shelves 16, 17 and 18 are supported in vertically spaced relation within the cabinet to provide shelf space for items of frozen food or the like. A narrow front wall flange 20 depends from the top wall 14. Such flange 20 and the upper edge of the front wall 15 define a vertical access opening 21 through which items on the various shelves 16 to 18 may be reached.

Figure 2:
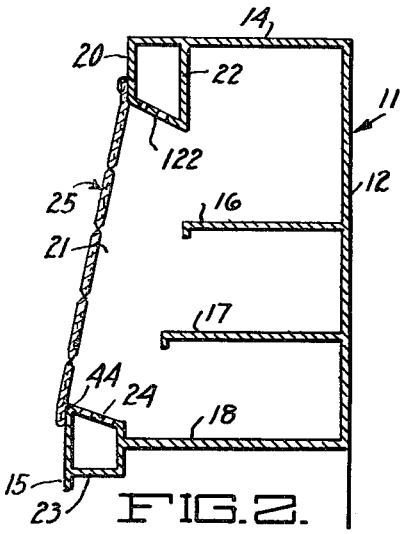
FIG. 2 is a transverse sectional view of the cabinet and cover.

It will be noted particularly in FIG. 2 that the flange 20 is located somewhat rearwardly of the front wall 15 so that the plane of the access opening 21 inclines upwardly and rearwardly.

A narrow conduit 22, including a perforated strip 122, extends along the length of the cabinet 11 and forms part of the wall flange 20 to enable a curtain of air from suitable refrigerating apparatus (not shown) to be passed downwardly through the perforated strip 122 and along the plane of the opening 21. A second conduit 23, including a perforated strip 24, also extends along the length of the cabinet 11 and defines the lower edge of the opening 21. The air curtain is drawn under vacuum into the conduit 23 and is recirculated to the refrigerating apparatus. Such air curtain reduces, to some extent, spillage of the cold air from the inside of the cabinet 11 outwardly through the opening 21 and also tends to prevent warm air from the surrounding atmosphere from entering the opening 21.

During business hours, the opening 21 is uncovered so that customers may conveniently reach through the opening to take whatever items they select from the shelves 16, 17 and 18. The aforementioned cabinet structure forms no part of the present invention.

According to the present invention, an elongate flexible insulating cover, generally indicated at 25, is provided for the purpose of covering the access opening 21 during off-hours, i.e., at night, during weekends, holidays, etc., or in cases of emergency when the refrigerating apparatus for the cabinet becomes inoperative.

The cover 25 comprises two thin flexible overlaid sheets 26 and 27 of Vinyl, Mylar or similar commercially available, flexible, moisture impervious plastic, preferably on the order of 0.015 inches thick. The overall size of the cover depends on the size of the access opening 21. For example, in one embodiment, the opening is 12 ft. 4 in. long and 38 in. high. However, the cover is preferably somewhat wider than the height of the opening 21 so as to overlap and adequately seal the edges of the opening.

Figure 3:
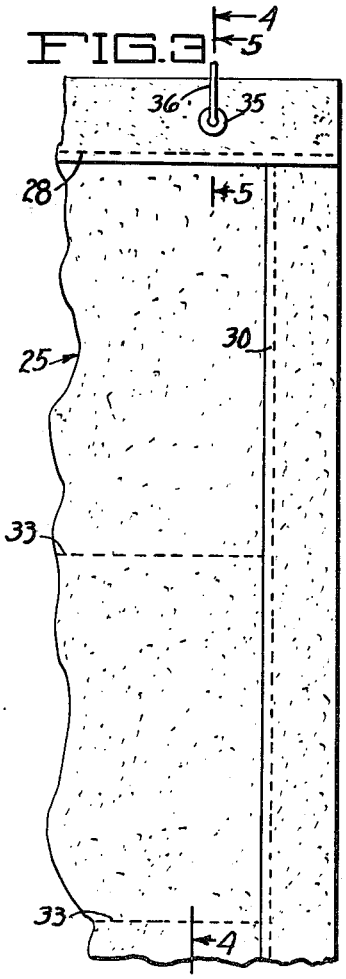
FIG. 3 is an enlarged fragmentary front view of the upper right hand portion of the cover.
Figure 4:
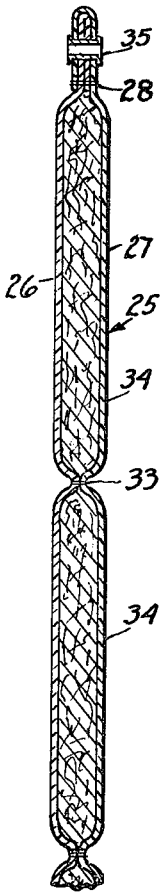
FIG. 4 is a transverse sectional view of the cover with the supporting hooks removed and is taken along line 4—4 of FIG. 3.
Figure 5:
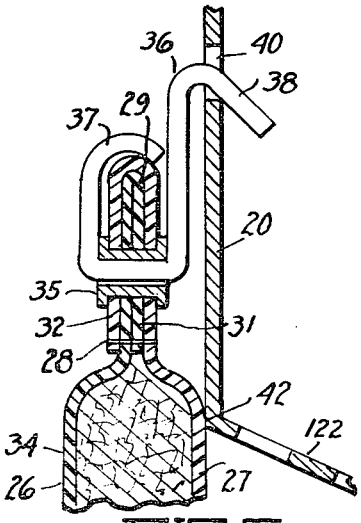
FIG. 5 is an enlarged transverse sectional view of the upper portion of the cover and is taken along line 5—5 of FIG. 3.

As seen particularly in FIGS. 3, 4, and 5, the plastic sheets 26 and 27 are secured and sealed together around their outer edges by lines of stitching, i.e., 28 and 30. For this purpose, and to provide a reinforced edge to enable suspending the cover over the access opening at spaced points along its length, the upper edge of the sheet 26 is folded back upon itself at 29 to form a reinforced edge portion 31. The upper edge of the sheet 27 is then folded over the edge portion 31 as shown at 32 to further reinforce the upper edge of the cover, and the line of stitching 28 is passed through the four superimposed plies of sheets 26 and 27. The side and bottom edges of the sheets 26 and 27 may be similarly secured together and sealed after being filled as will be described presently. A series of horizontally extending seams 33 are formed by stitching the sheets 26 and 27 together to form contiguous hollow narrow panels 34 extending the length of the cover. Such panels are substantially filled with loosely packed, non-oriented glass fibers to a thickness on the order of one inch, after which the ends of the sheets 26 and 27 are secured together and sealed as mentioned above.

Accordingly, the cover is sealed against the entrance of moisture and further, it is sealed against the loss of glass fibers which could otherwise contaminate the food items within the covered cabinet.

Means are provided to removably suspend the cover 25 over the opening 21. For this purpose, eyelets 35 are passed through the upper reinforced edge portions 31, 32 of the cover at spaced intervals. Wire hooks 36 are secured through such eyelets 35. Each hook 36 is bent over at 37 to secure the same to the cover and is provided with an inclined hook portion 38 which is intended to be removably fitted within an aligned hole 40 in the cabinet flange 20.

When mounting the cover 25 over the opening 21, the hooks 38 are merely inserted in the corresponding holes 40 in the cabinet flange 20. Each hook portion 38 slides or cams along the lower edge of its hole 40 until a portion of the uppermost cover panel 34 sealingly engages the lower edge of the cabinet flange 20 as indicated at 42 (FIG. 5). Also, due to the inclined plane of the access opening 21 and the flexible nature of the cover 25, the latter drapes over the opening 21, enabling the lower portion thereof to sealingly engage the upper edge of the front wall 15, as indicated at 44 (FIG. 2), to prevent escape of cold air from the cabinet interior. Likewise, the end portions of the cover 25 drape against the forward edges 43 of the end walls 13 to prevent escape of cold air at the ends of the cover.

Due to the formation of the contiguous narrow horizontally extending panels 34, the loosely packed insulating fibers cannot settle to the bottom of the cover 25 as the result of handling. Also, the seams 33 form relatively flexible hinge lines so that the cover can be easily folded along any selected seam. Yet, such seams do not appreciably reduce the thermal insulating characteristics of the cover. Additionally, the cover 25 is relatively light, enabling a single person to readily fold and carry the same and to hang it in place, regardless of its size. Yet, the cover presents an effective thermal barrier of substantially even thickness throughout. For example, in tests conducted on a cabinet of the aforementioned size, under actual working conditions, it was determined that by employing the cover of the present invention during off business hours, a savings of over 2700 kilowatt hours per month was effected.

It will be obvious to those skilled in the art that many variations may be made in the exact construction shown without departing from the spirit and scope of this invention.

I claim:

1. An insulating cover for covering the forward facing access opening of a vertical display type refrigerating cabinet comprising a pair of elongate overlying sheets of relatively thin flexible material, said sheets being secured together along their edges, said sheets being further secured together along parallel seam lines extending lengthwise of said sheets to form contiguous hollow panels extending the length of said cover, relatively thick layers of heat insulating fibers at least substantially filling said panels, means for removably suspending the upper side edge of said cover along the upper edge of said opening whereby the remainder of said cover drapes over said opening, said seam lines forming hinge lines along which said cover may be folded, said cabinet having supporting openings therein above said access opening, said suspending means comprising hooks attached to said cover along said upper edge, said hooks having downwardly inclined portions adapted to extend through said supporting openings whereby the weight of said cover causes said hooks to press said cover into sealing engagement with said cabinet.

2. An insulating cover for covering the forward facing access opening of a vertical display type refrigerating cabinet, said cabinet having supporting openings therein above said access opening, comprising:

a pair of elongate overlying sheets of relatively thin, flexible material, said sheets being secured along their edges, said sheets being further secured together along parallel seam lines extending lengthwise of said sheets to form contiguous hollow panels extending the length of said cover, relatively thick layers of heat insulating fibers at least substantially filling said panels, said seam lines forming hinge lines along which said cover may be folded, means for removably suspending the upper side edge of said cover along the upper edge of said access opening whereby the remainder of said cover drapes over said opening, the upper edge of a first one of said sheets being folded back upon itself to form a reinforced portion and the upper edge of the other of said sheets being folded over said reinforced portion to form an additional reinforced portion, supporting eyelets extending through said reinforced portions for receiving said suspending means for said cover, said cover comprising hooks extending through said eyelets and attached to said reinforced portions, said hooks having downwardly inclined hook portions adapted to extend through said supporting openings whereby the weight of said cover causes said hooks to press the cover into sealing engagement with said cabinet.

* * * * *